United States Patent [19]

Dobashi et al.

[11] Patent Number: 4,931,685

[45] Date of Patent: Jun. 5, 1990

[54] DISCHARGE LAMP

[75] Inventors: Yoshitomi Dobashi, Fujisawa; Rikio Yamamoto, Kawasaki, both of Japan

[73] Assignee: Kabushiki Kaisha Toshiba, Kawasaki, Japan

[21] Appl. No.: 233,814

[22] Filed: Aug. 19, 1988

[30] Foreign Application Priority Data

Aug. 21, 1987 [JP] Japan ..... 62-127338[U]

[51] Int. Cl.[5] ..... H01J 61/52

[52] U.S. Cl. ..... 313/15; 313/489

[58] Field of Search ..... 313/15, 489, 496, 607, 313/622, 10, 13, 493

[56] References Cited

U.S. PATENT DOCUMENTS

| | | | |
|---|---|---|---|
| 2,581,959 | 1/1952 | Koehler | 313/15 X |
| 3,274,420 | 9/1966 | Kameyama et al. | 313/493 |
| 4,147,947 | 4/1979 | Hoeh | 313/493 X |
| 4,656,561 | 4/1987 | Shinbo et al. | 313/15 X |

FOREIGN PATENT DOCUMENTS

| | | | |
|---|---|---|---|
| 49-41481 | 4/1974 | Japan . | |
| 58-198850 | 11/1983 | Japan | 313/13 |
| 60-39562 | 3/1985 | Japan . | |
| 60-202653 | 10/1985 | Japan | 313/15 |

*Primary Examiner*—Sandra O'Shea

*Attorney, Agent, or Firm*—Cushman, Darby & Cushman

[57] ABSTRACT

A discharge lamp includes a bulb in which a pair of electrodes are installed and mercury and a rear gas are sealed. A heater unit is tightly attached to the outer surface of the bulb by a heat-shrinkable tube fitted over the bulb. The heater unit includes a thin flexible heater for heating the bulb to promote the evaporation of the mercury, and a pair of film members fixed on both sides of the heater so as to reinforce the heater.

16 Claims, 4 Drawing Sheets

DISCHARGE LAMP

BACKGROUND OF THE INVENTION

1. Field of the Invention

This invention relates to a discharge lamp and more particularly to a discharge lamp having a heater tightly attached to the outer surface of the bulb.

2. Description of the Related Art

Recently cold cathode fluorescent lamps and hot cathode fluorescent lamps are used for the back light for liquid crystal televisions and liquid crystal displays. The liquid crystal televisions and liquid crystal displays are sometimes used in environments with harsh temperature conditions. For example, fluorescent lamps used as the back light of the automobile meters are used in a wide temperature range of from about +40° C. to −30° C. Even in such a severe temperature condition, the lamps are required to have sufficient startability and rise-up characteristics.

A well-known method of improving the rise-up characteristics of lamps in a cold climate is to attach a heater to the outer surface of the bulb. In lamps with such a heater, the heater is supplied with electricity to generate heat to make the bulb warm, thereby facilitating the evaporation of mercury contained in the bulb. Thus, the vapor pressure of the mercury can be raised rapidly. As a result, the lamp can be started and the rise-up of the luminous flux is quickened, thereby reducing the time required for the lamp to reach the stable lighting condition.

When a heater is used, the temperature distribution of the lamp should be uniform at least in the axial direction of the bulb. Therefore, the generally adopted construction of discharge lamps is such that a heater in a band shape is placed in the axial direction of the bulb.

A heater of band shape must be secured in close contact with the outer surface of the bulb. For this reason, the heater is required to be in a thin plate and flexible, that is, deformable to cover the outer surface of the bulb, like a mesh heater. A possible fixing method of such a flexible heater to the outer surface of the bulb is to glue the heater to the bulb outer surface with an adhesive. In this case, however, there is a possibility of the heater coming off due to the deterioration with time of the adhesive. Further, it takes time for the adhesive to be dried, resulting in a longer manufacturing time of the lamp. Therefore, proposed is a construction that a heater is fixed to the outer surface of the bulb by means of a light-transmitting tube, particularly, by a heat-shrinkable tube, fitted over the full length of the bulb.

However, flexible heaters in a band shape are low in mechanical strength and are likely to be deformed or subject to breaking when they are handled. When a flexible heater is fixed to the bulb by a heat-shrinkable tube, since the tube does not uniformly shrink in the axial direction, the heater is likely to have stresses induced inside and have wrinkles. If deformation such as wrinkles occurs in the heater, the bulb cannot be heated efficiently and there is a high possibility that discontinuity occurs in the heater.

SUMMARY OF THE INVENTION

This invention has been made in view of the above situation and has as its object to provide a discharge lamp which is capable of preventing the deformation or breaking of the heater, heating the bulb efficiently and improving yield.

To achieve the above object, the discharge lamp of this invention comprises a bulb having an inner surface on which a phosphor layer is formed and an electrode installed inside, said bulb having mercury and a rare gas contained; a heater unit tightly attached to the outer surface of the bulb and extending in the axial direction of the bulb, for heating the bulb to promote the evaporation of the mercury contained, said heater unit having a thin flexible heater made of metal and a film member fixed at least on one side of the heater to reinforce the heater; and covering means fitted over the outer surface of said bulb to enclose the heater unit, for fixing the heater unit to the outer surface of the bulb.

With the discharge lamp having the above mentioned construction, a film member is fixed to the thin flexible heater, thereby improving mechanical strength of the heater. Consequently, the heater can be prevented from being deformed or cracked during its handling, making it easy to handle heaters. In addition, the deformation of the heater can be prevented when the heater is fixed to the outer surface of the bulb by using the covering means.

BRIEF DESCRIPTION OF THE DRAWINGS

FIGS. 1 through 7 show a discharge lamp according to a first embodiment of this invention, in which FIG. 1 is a perspective view of the lamp, FIG. 2 is a perspective view of the lamp with a connector being disassembled, FIG. 3 is an exploded perspective view of a heater unit, FIG. 4 is a sectional view taken along line IV—IV in FIG. 1, FIG. 5 is a sectional view showing a part of FIG. 4 on at enlarged scale, FIG. 6 is a sectional view showing one end portion of the bulb, and FIG. 7 is a sectional View, taken along line VII—VII in FIG. 1;

DETAILED DESCRIPTION OF THE PREFERRED EMBODIMENTS

Figure 1:
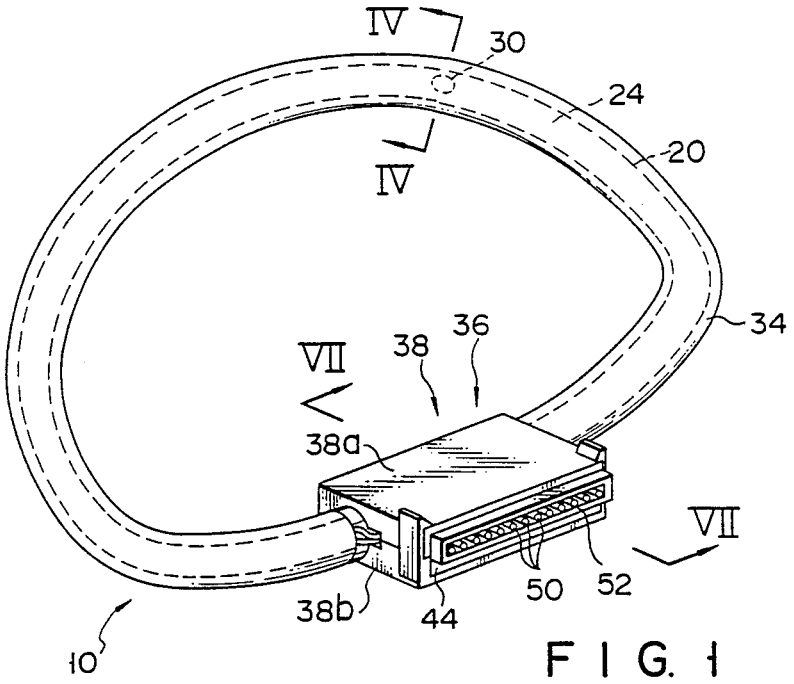

With reference to the accompanying drawings, the preferred embodiments of this invention will now be described in the following.

FIGS. 1 through 7 show a cold cathode fluorescent lamp constructed as a source of back light for the meters of vehicles. This lamp comprises bulb 10 made of quartz, hard glass or soft glass. Bulb 10 is formed by bending into a circle and has a couple of end portions spaced apart by a specified distance and facing each other. As is clear from FIG. 4, bulb 10 has phosphor layer 12 formed on the inner periphery thereof. Bulb 10 contains a specified amount of mercury and at least one of rare gases such as xenon, krypton, argon, neon and helium.

In each end portion of bulb 10 is provided internal electrode 14 (only one of them is shown). Electrodes 14 are cold cathode electrodes made of nickel for example, and each connected to lead wire 16. Lead wires 16 penetrate the end walls of bulb 10 in an airtight manner and extend outwards. Lead wires 16 are connected to power supply cords 18*a*, respectively. External electrode 20 is tightly attached to one side of the outer periphery of bulb 10. Electrode 20, formed in a band having a substantially constant width, extends in the axial direction of and over a substantially full length of bulb 10. Electrode 20 is made by applying an electrically conductive coat, silver paste for example, on the outer surface of bulb 10. A pair of power supply cords 18*b* are connected to both ends of electrode 20, respectively. Electrical insulating coat 22 is formed on the outer surface of electrode 20.

Figure 3:
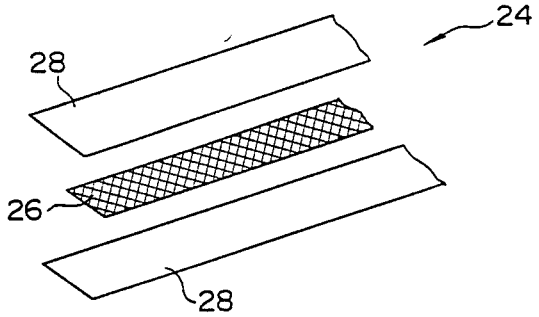
Figure 4:
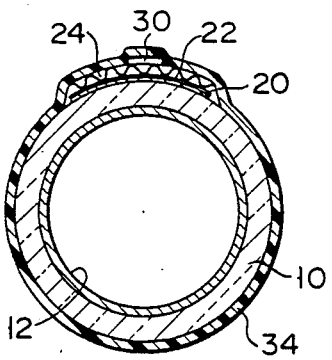
Figure 5:
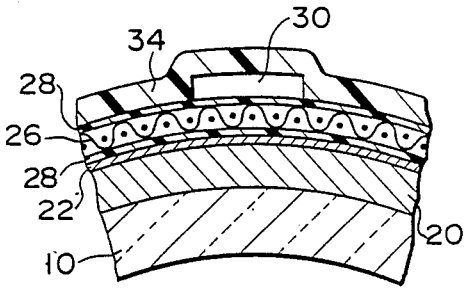
Figure 6:
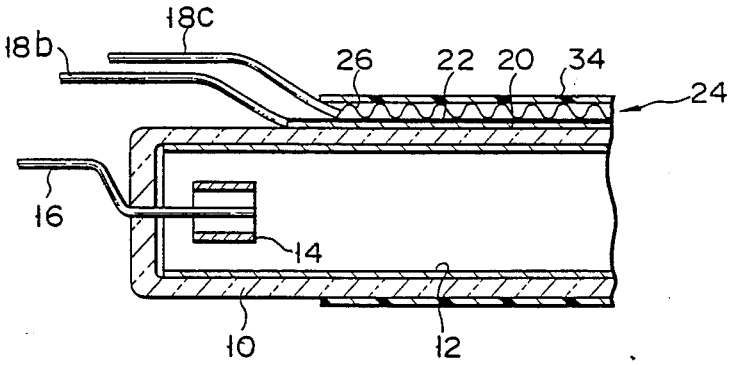

Mounted on top of insulating coat 22 is band-shaped heater unit 24 extending in the axial direction over a substantially full length of bulb 10. Referring to FIG. 3, heater unit 24 is in a laminated construction in which band-shaped mesh heater 26 is sandwiched on both sides by a pair of resin films 28 in a band shape. More specifically, heater 26 is first held between films 28 and then these films 28 are fused together by heat to have the heater embedded therein. Mesh heater 26 is constituted by making a porous thin net from a thin stainless steel sheet by chemical etching. For resin film 28, a transparent resin film with heat resistance and electrical insulation properties such as polycarbonate film is used. Power supply cords 18*c* are connected to both ends of heater 26. Temperature sensor 30 for detecting the temperature of heater 26 and bulb 10 is located on heater unit 24 and at the middle portion of bulb 10. Sensor 30 is connected with a pair of signal cords 32 which extend along bulb 10 and led out from one end of the bulb.

To hold heater unit 24, temperature sensor 30 and signal cords 32 on the outer surface of bulb 10 and particularly to hold heater unit 24 tightly attached to the outer surface of insulating coat 22, a resin tube with light permeability such as heat shrinkable tube 34 is fitted over bulb 10 to cover sensor 30 and cords 32. If tube 34 is heated with being fitted over bulb 10, it shrinks, coming into close contact with the outer surface of bulb 10. As a result, heater unit 24 is pressed to the outer surface of bulb 10 by the shrinkage of tube 34 and held in close contact with insulating coat 22. Likewise, sensor 30 and signal cords 32 are held pressed tightly to the outer surface of heater unit 24 by shrank tube 34. Since tube 34 is a little shorter than the length of bulb 10, the end portions of the bulb are exposed.

Figure 2:
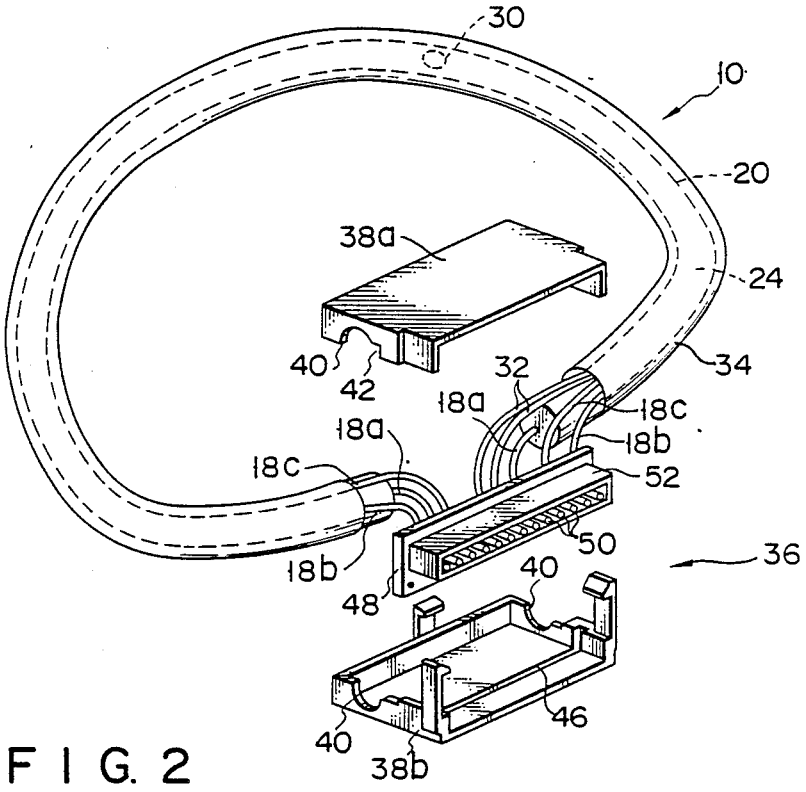
Figure 7:
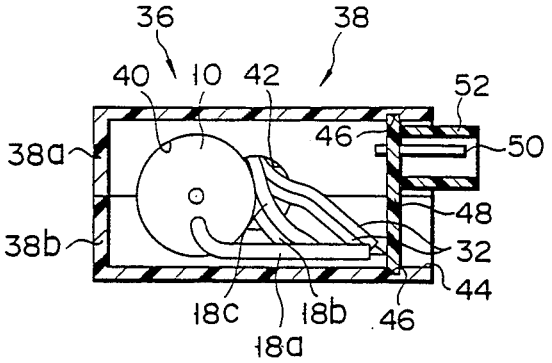

As is apparent from FIGS. 1, 2 and 7, connector 36 is mounted on bulb 10 such that it sits astride the ends of bulb 10. Connector 36 has box-shaped cover 38 made of an insulating material such as a syntheric resin. The ends of bulb 10 are inserted into cover 38 through inserting holes 40 cut in the two opposed side walls of cover 38. Inserting holes 40 are a little larger than the outer diameter of bulb 10 and have recessed parts 42. Power supply cords 18*a* to 18*c* and signal cords 32 are passed through these recessed parts 42 and inserted into cover 38. Cover 38 is formed of cover halves 38*a* and 38*b* joined separably so that it can be mounted to and dismounted from the ends of bulb 10.

Cover 38 is open on one side and has holding groove 46. Groove 46 is formed on the inner surface of cover 38 in the vicinity of opening 44 and extends around the inner circumference of cover 38. The peripheral edge of rectangular wiring board 48 is fitted into holding groove 46. In this way, the wiring board is held mechanically in cover 38. Printed wiring is provided on wiring board 48. Power supply cords 18*a* to 18*c* and signal cords 32 are connected by soldering to the printed wiring. Connector body 52 having a plurality of connection terminals 50 arranged in a line is fixed to board 48 and extends outwards through opening 44 of cover 38. Connection terminals 50 are soldered to the printed wiring of wiring board 48 and therefore, mechanically secured to the board. Connector body 52 is connected with a connector on the power supply side, not shown.

The operation of the cold cathode fluorescent lamp thus constructed will now be described.

First, a connector on the power supply side is connected to connector 36. By this, internal electrodes 14 are connected with the power supply and voltage is applied to external electrode 20. As a result, external electrode 20 serves as a proximity conductor to promote the electric discharge of internal electrodes 14, causing glow discharge to take place in bulb 10. By such an action of external electrode 20, the startability of the lamp can be improved and the starting voltage reduced. The glow discharge causes the mercury vapor sealed in bulb 10 to radiate ultraviolet rays, exciting phosphor layer 12 on the inner periphery of the bulb, and the phosphor layer emits visible rays. The visible rays radiate outwards through bulb 10 and tube 34.

Temperature sensor 30 detects the temperature of the outer surface of bulb 10. When the detected temperature is lower than a specified value, power is applied to heater 26 of heater unit 24 and the heater generates heat to warm up bulb 10. As the temperature of the inside of bulb 10 rises, the evaporation of mercury in the bulb is promoted and the mercury vapor pressure goes up rapidly to a desired value. Hence, the time for the lamp to reach a stable lighting condition is shortened. In other words, the rise-up time of the lamp can be reduced. When bulb 10 reaches a specified temperature, sensor 30 issues a signal, in response to which the power supply to heater 26 is stopped.

Heat-shrinkable tube 34, fitted over the outer surface of bulb 10, serves as a heat retaining material to reduce the quantity of heat radiated from the bulb. The heat retaining function of tube 34, in addition to the heating by heater unit 24, further promotes the rising of the mercury vapor pressure, resulting in the rise-up time of the lamp being further shortened.

In the fluorescent lamp described above, mesh heater 26 is sandwiched on both sides by polycarbonate films 28 to form heater unit 24 of laminated construction. Compared with conventional heater units with a heater exposed, heater unit 24 has a very high mechanical strength and never allows the heater to be deformed or cracked when it is handled. Hence, the ease in handling heater 26 is improved greatly.

Since heater unit 24 has a high mechanical strength as described above, the possibility of wrinkle occurrence in heater 26 is reduced in fixing heater unit 24 to the outer surface of bulb 10 by the use of heat-shrinkable tube 34. Therefore, heater unit 24 can be securely brought into tight contact with the outer surface of bulb 10 to ensure an improved heating efficiency. In addition, yield in lamp production can be increased.

Power supply cords 18a to 18c connected to internal electrodes 14, external electrode 20 and heater 26, and signal cords 32 connected to temperature sensor 30 are connected to single connector 36. As a result, the lamp can be connected with the power supply, the control circuit, etc. simply by connecting a single connector on the power supply side to connector 36. Compared with a case where different connectors have to be connected for different cords, the construction of the whole connector is simpler and the connecting work with the connector on the power supply side is easier.

Furthermore, the lead-out portions of the cords are housed in cover 38 of connector 36 and do not extend in different directions around the lamp. Therefore, the surroundings of a lamp can be kept in good order. Moreover, connector 36 is located between the ends of bulb 10 and held stably by the bulb. This facilitates the connection and disconnection of the connector of the power supply side with connector 36. Also, since the ends of bulb 10 are coupled with each other by connector 36, the strength of the bulb is improved.

The soldered parts of connection terminals 50 and those of the cords on wiring board 48 are covered by cover 38 of connector 36. This prevents an inadvertent touching of the soldered parts or a short-circuit between the soldered parts.

This invention is not limited to the above embodiment but may be embodied in various forms within the scope of this invention.

Figure 8:
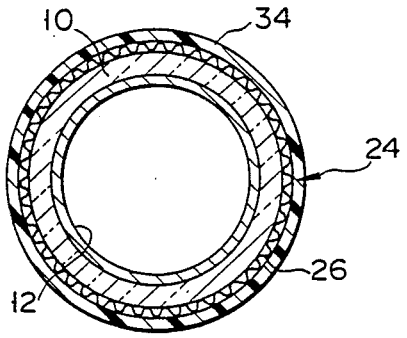
FIG. 8 is a sectional view of a discharge lamp according to a second embodiment of this invention.

For example, as is shown in FIG. 8, heater unit 24 incorporating heater 26 having a width almost the same as the outer diameter of bulb 10 may be fitted over the whole peripheral surface except for the ends of bulb 10. In this case, heater 26 needs to be formed in a mesh and film 28 is required of have a light permeability. In a fluorescent lamp of the type shown in the firs embodiment of this invention, the brightness is low at the end portions of the bulb in the luminous intensity distribution in the axial direction of the lamp. As in the embodiment shown in FIG. 8, when heater unit 24 is fitted over the whole outer surface of bulb 10 except for its end portions, the brightness of the middle portion of the bulb decreases and approaches that of the end portions of the bulb. Thus, the luminous intensity distribution in the axial direction of the bulb can be made close to uniform.

Figure 9:
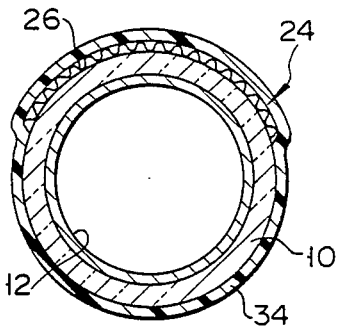
FIG. 9 is a sectional view of a discharge lamp according to a third embodiment of this invention.

Film 28 of heater unit 24 is not limited to a resin film but may be formed of a metal foil. In this case, it is necessary to prevent shorting of the heater by applying an electrical insulation treatment to the surfaces of films 28 and/or the surface of heater 26. As is shown in FIG. 9, when heater unit 24 having film 28 consisting of a metal film is fitted over substantially half the outer peripheral range of bulb 10, heater unit 24 can serve also as a reflector to radiate light from the lamp in desired directions.

Figure 10:
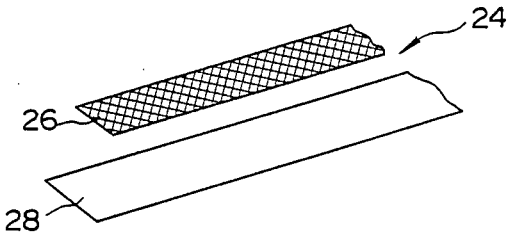
FIGS. 10 and 11 are perspective views showing different modifications of the heater unit.
Figure 11:
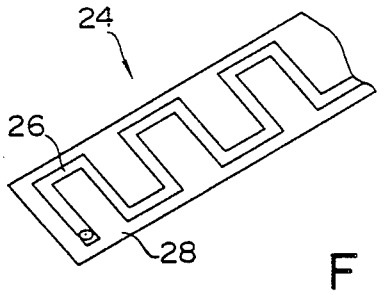

Referring to FIG. 10, heater unit 24 may be composed of heater 26 and a single piece of film 28 fused to the heater. In the thus constructed heater unit, the heater is imparted with a far greater mechanical strength than a case where heater 26 is used as a single, independent body. In addition, heater 26 is not limited to a mesh heater but may be a plane heater in a band shape consisting of a metal foil or a meandering heater consisting of a metal foil, as is shown in FIG. 11.

Figure 12:
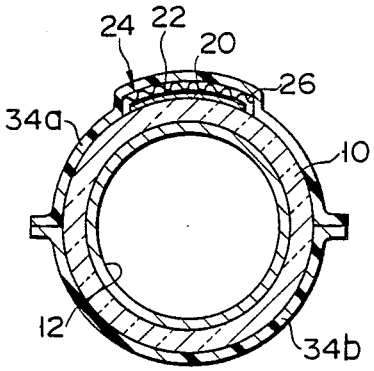
FIG. 12 is a sectional view of a first modification of a covering tube.

The covering material fitted over the outer surface of bulb 10 is not limited to a resin tube but may be formed of two sheets of light-permeable resin films 34a and 34b, as is shown in FIG. 12. These films 34a and 34b are fitted, from above and below, onto bulb 10 having heater unit 24, a temperature sensor, etc. mounted thereon. Then, side edges of films 34a and 34b are fused together by heat. Thereafter, films 34a and 34b shrink as they are heated and stay attached firmly to the outer surface of bulb 10.

Attaching the covering materials of the above construction to the outer surface of the bulb is far easier than inserting a bulb into a tube as in a case where a tube-shaped covering material is used. The difference is particularly notable when covering material is applied to a bent or very long bulb.

Figure 13:
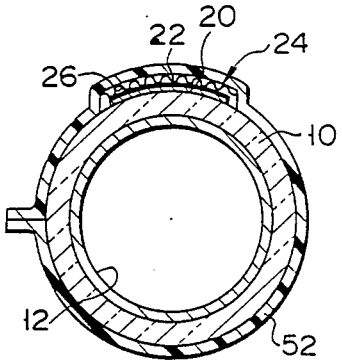
FIG. 13 is a sectional view of a second modification of the covering tube.

Instead of using a pair of resin films, it is possible to use the method as is shown in FIG. 13. In this case, a single sheet of resin film 52 is wrapped around the outer surface of bulb 10 and the long-side ends of the film are put together by joining the end portions. By this method, too, the same advantages can be obtained as in the above embodied example.

Figure 14:
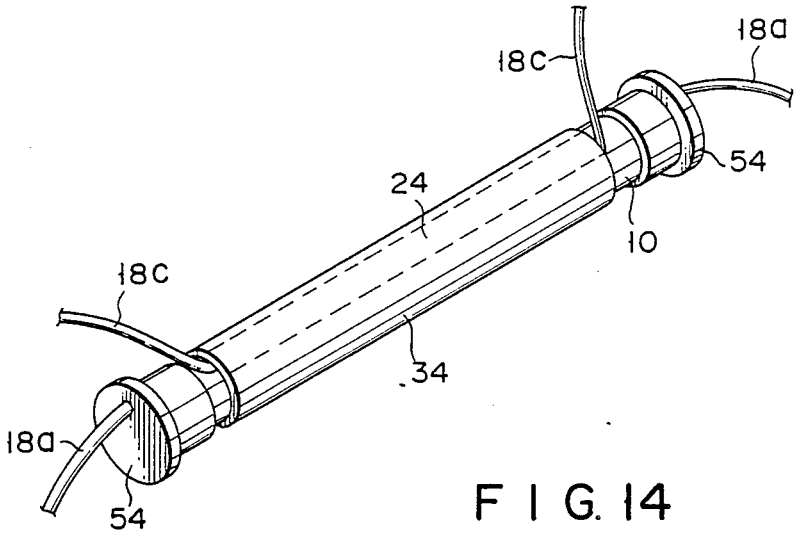
FIG. 14 is a perspective view of a discharge lamp according to a fourth embodiment of this invention.

This invention is not limited to lamps using circular bulbs but may be applied to straight-tube lamps as is shown in FIG. 14. In FIG. 14, the the numeral 54 indicates resin caps to protect the bulb ends when the caps are attached thereto. Furthermore, this invention is not limited to cold cathode fluorescent lamps but may be applied to hot cathode fluorescent lamps. When an external electrode is used, the internal electrode may be one. This invention can be applied also to lamps having two internal electrodes and no external electrode.

What is claimed is:

1. A discharge lamp comprising:

a bulb having an inner surface on which a phosphor layer is formed and an electrode installed inside, said bulb containing mercury and a rare gas therein;

a heater unit, attached to the outer surface of the bulb and extending in the axial direction of the bulb for heating the bulb to promote the evaporation of the mercury contained, said heater unit having a thin flexible heater and a film member prefixed at least on one side of the heater to reinforce the heater; and covering means fitted over the outer surface of the bulb to enclose the heater unit, for fixing the heater unit to the outer surface of the bulb.

2. A discharge lamp according to claim 1, wherein said heater unit has a pair of film members which hold the heater from both sides thereof.

3. A discharge lamp according to claim 1, wherein said film member is formed of a heat-resistant resin.

4. A discharge lamp according to claim 1, wherein said film member is formed of an electrically insulating resin.

5. A discharge lamp according to claim 1, wherein said film member is formed of a light-permeable resin.

6. A discharge lamp according to claim 1, wherein said film member is formed of a metal foil which acts as a reflecting film for the bulb, with at least one of the heater and the film member being covered with an electrical insulation coating.

7. A discharge lamp according to claim 1, wherein said heater unit is formed in a band shape and extends over substantially the full length of the bulb.

8. A discharge lamp according to claim 1, wherein said heater is formed in a mesh and has a width substantially the same as the outer diameter of the bulb.

9. A discharge lamp comprising:

a bulb having an inner surface on which a phosphor layer is formed and an electrode installed inside, said bulb containing mercury and a rare gas;

a heater unit, attached to an outer surface of the bulb and extending in an axial direction of the bulb, for heating the bulb to promote evaporation of the mercury therein, said heater unit having a thin flexible heater and a pair of film members fixed to both sides of the heater to reinforce the heater; and covering means fit over the outer surface of the bulb to enclose the heater unit, for fixing the heater unit to the outer surface of the bulb.

10. A discharge lamp according to claim 9, wherein said film members are formed of a resin film and thermally fused together with the heater placed therebetween.

11. A discharge lamp according to claim 9, wherein said covering means has a light-permeable resin tube.

12. A discharge lamp according to claim 11, wherein said resin tube is a heat-shrinkable tube.

13. A discharge lamp according to claim 9, wherein said covering means includes a pair of light-permeable resin films, the resin films being fitted over the bulb from two sides of the bulb and side ends of one resin film are joined with side ends of the other resin film.

14. A discharge lamp according to claim 9, wherein said covering means includes a light-permeable resin film, the resin film being wrapped around the outer surface of the bulb and having side ends joined with each other.

15. A discharge lamp according to claim 9, wherein said bulb is formed in a substantially circle and has a pair of opposed ends spaced apart by a specified distance.

16. A discharge lamp according to claim 9, which further comprises a sensor for detecting the temperature of the bulb, the sensor being fixed to the outer surface of the bulb by the covering means.

* * * * *